United States Patent [19]

Randhawa

[11] Patent Number: 4,898,768

[45] Date of Patent: Feb. 6, 1990

[54] LAYERED STRUCTURE FOR ADHERING GOLD TO A SUBSTRATE AND METHOD OF FORMING SUCH

[75] Inventor: Harbhajan S. Randhawa, Boulder, Colo.

[73] Assignee: Vac-Fec Systems, Inc., Boulder, Colo.

[21] Appl. No.: 312,622

[22] Filed: Feb. 17, 1989

[51] Int. Cl.[4] ..... B32B 7/02; B32B 15/04

[52] U.S. Cl. ..... 428/216; 428/336; 428/457; 428/472; 428/698; 428/699

[58] Field of Search ..... 428/457, 698, 672, 627, 428/216, 336, 472, 699; 427/37

[56] References Cited

U.S. PATENT DOCUMENTS

| | | | |
|---|---|---|---|
| 4,252,862 | 2/1981 | Nishida | 428/457 |
| 4,333,962 | 6/1982 | Pulker et al. | 427/37 |
| 4,403,014 | 9/1983 | Bergmann | 428/672 X |
| 4,591,418 | 5/1986 | Snyder | 428/698 X |
| 4,753,851 | 6/1988 | Roberts et al. | 428/627 |

*Primary Examiner*—Thomas J. Herbert
*Attorney, Agent, or Firm*—Brian D. Smith

[57] ABSTRACT

A layered structure for adhering gold to a substrate and a method of forming such on a substrate are disclosed. An article of jewelry or the like which is formed by the disclosed method and which includes the disclosed layered structure is also disclosed. The layered structure includes a first layer overlying the substrate. The first layer includes a member selected from the group consisting of metal nitrides, metal carbides and metal carbonitrides wherein the metal is selected from the group consisting of titanium, zirconium and hafnium. The layered structure also includes a transparent layer of refractory metal which overlies the first layer and underlies the gold or alloy thereof. The disclosed method includes forming the aforementioned first layer over the substrate and then forming the transparent layer of refractory metal on the first layer. Both the first layer and transparent layer are preferably formed or deposited on the substrate by a cathodic arc plasma deposition process. The method also includes forming a top layer of gold or an alloy thereof on the transparent layer, which gold layer is preferably formed or deposited by a magnetron sputtering process. The article of jewelry or the like includes a substrate and a multi-layered coating which can be formed on the substrate by the disclosed method.

10 Claims, 2 Drawing Sheets

FIG. 4
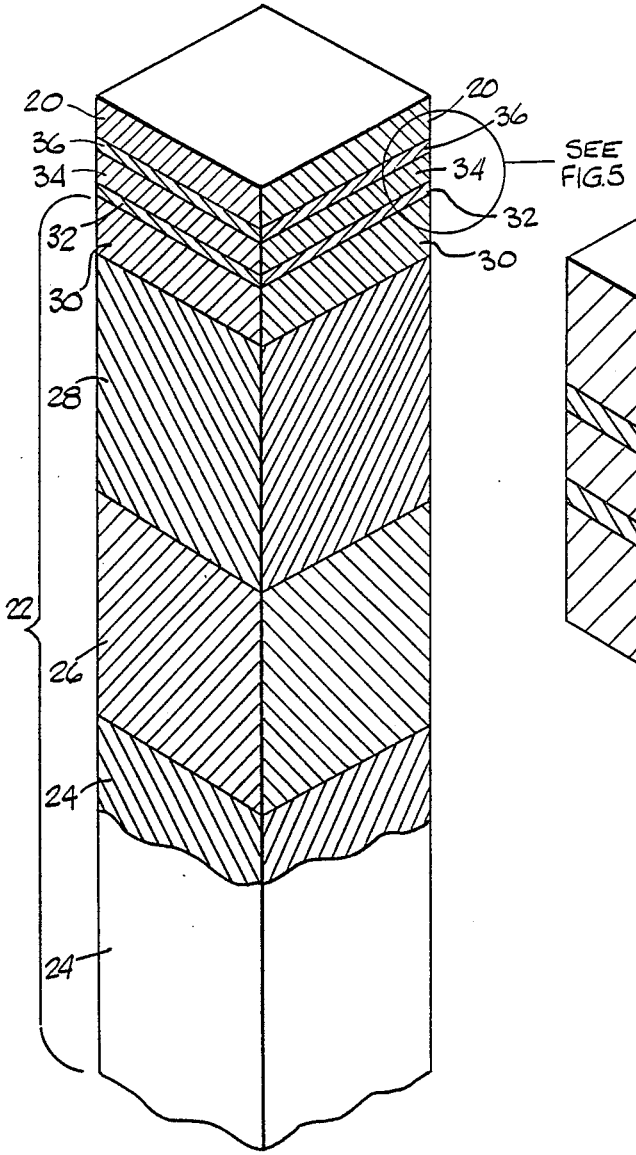
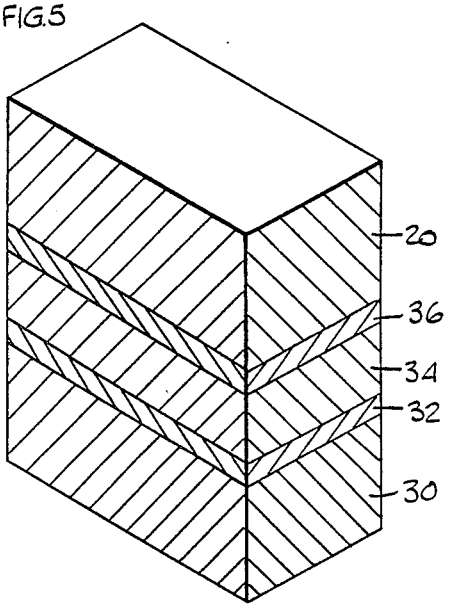
FIG. 5

LAYERED STRUCTURE FOR ADHERING GOLD TO A SUBSTRATE AND METHOD OF FORMING SUCH

TECHNICAL FIELD OF THE INVENTION

The present invention relates, in general, to coating objects such as jewelry. More particularly, the present invention relates to layered structures for adhering gold or an alloy thereof to an underlying substrate.

BACKGROUND OF THE INVENTION

It is well known that golden colored articles such as jewelry can be produced by depositing a coating of a metal nitride and/or carbide on the surface of the article. Processes for depositing such coatings have been the subject of numerous studies and patents. For example, Pulker et al. U.S. Pat. No. 4,333,962, discloses a process wherein a metal such as titanium or zirconium is evaporated in an activated nitrogen containing atmosphere to produce a metal nitride which is deposited on a substrate to produce a wear resistant, gold colored product.

While such processes produce highly wear-resistant gold coatings, the coatings d not, unfortunately, possess the same brilliance as real gold or a gold alloys. Accordingly, it is often desirable to apply an additional coating of real gold or gold alloy on top of the hard wear-resistant coating. Nishida U.S. Pat. No. 4,252,862 discloses such a process wherein a layer of titanium nitride is first deposited on a substrate by an ion plating process using an electron beam source. A layer of gold or gold alloy is then deposited on the titanium nitride layer using a resistance heated source. Another process attempting to produce a coating having both the brilliance of gold and the wear resistance of hard coatings such as titanium nitride is disclosed in Bergman U.S. Pat. No. 4,403,014. The Bergman process produces a gold composite containing both gold and a metal nitride, carbide or boride. While an interesting concept, the atomic mixing of gold with metal nitrides, carbides or borides does not result in a simple integration of desirable properties, i.e., the gold composite does not possess both wear-resistance and the brilliance of gold. In fact, the gold composites produced by Bergman's process are not even as yellow as titanium nitride coatings. Bergman's gold composites also have low luster in comparison to real gold or gold alloys. In addition, an undesirable continuous or stepwise gradient of composition also occurs in these composites along with the presence of substantial amounts of gold-titanium intermetallic compounds which form during the growth of such composites.

Yet another approach to the problem of color and wear resistance is disclosed in Snyder U.S. Pat. No. 4,591,418. This process uses cathodic sputtering to coat an article with alternative thin layers of titanium nitride and gold alloys. The laminated coating produced thereby has at least five layers and, while interesting, the laminate has been found to delaminate in time.

This delaminating or latent adhesion problem as sometimes referred to herein is believed to be caused by the alloying ingredients in gold. These alloy ingredients, particularly copper, zinc and indium are believed to diffuse to the interface of the hard coating and gold alloy in time. Once a significant concentration of these elements builds up at the interface, the gold alloy layer peels off or delaminates from the underlying hard coating layer. Thus, articles or ornaments having such coatings will, quite obviously, have a limited shelf life. A consumer having recently purchased such a product is also likely to become quite agitated if he or she notices the gold layer peeling off his recently purchased product. The problem is also not easily solved by using a layer of pure gold i.e. gold without any alloying ingredients since pure gold rarely has the color which is desired color for a particular application. To obtain the desired color, alloying ingredients must be added to the gold to tint or adjust the color as desired. Pure gold also wears away very easily. It is also, quite obviously, more expensive than most of its alloys.

DISCLOSURE OF THE PRESENT INVENTION

An object of the present invention is to prevent the outer gold layer on gold coated articles such as watch cases, jewelry and rings from peeling off the article.

Another object of the present invention is to produce gold coated articles having a long shelf life.

Another object of the present invention is to produce gold coated articles having excellent wear and corrosion resistance.

In accordance with these objects, the present invention provides a layered structure for adhering gold and gold alloys to a substrate. The present invention also provides a method for forming or applying a coating to a substrate which includes an outer gold or gold alloy layer and the layered structure of the present invention. The present invention also provides an article of jewelry or the like having an outer gold layer which is secured to the article by the layered structure of the present invention.

The layered structure of the present invention for adhering gold or gold alloys to a substrate includes a hard coating or a first layer as referred to herein which overlies the substrate. The hard coating or first layer includes a member selected from the group consisting of metal nitrides, metal carbides and metal carbonitrides wherein the metal is selected from the group consisting of titanium, zirconium and hafnium. The layered structure of the present invention also includes a transparent layer of refractory metal such as titanium, zirconium and hafnium which overlies the hard coating or first layer and underlies the gold or alloy thereof. In a preferred embodiment, the transparent layer of refractory metal has a thickness between about 25 angstroms and 100 angstroms.

The method of the present invention for applying a coating to a substrate includes the step of forming the aforementioned first layer or hard coating over the substrate and then forming the aforementioned transparent layer of refractory metal on the first layer. The first layer and the transparent layer are preferably formed or deposited by a cathodic arc plasma deposition process. The method of the present invention also includes forming a top layer of gold or an alloy thereof on the transparent layer of refractory metal. The top layer is preferably formed or deposited on the transparent layer by a magnetron sputtering process.

The article of jewelry or the like of the present invention includes a substrate and a multi-layered coating on the substrate. The multi-layered coating includes the aforementioned first layer which overlies the substrate, the aforementioned transparent layer of refractory metal which overlies the first layer and the aforementioned top layer of gold or gold alloy which overlies the transparent layer.

Additional advantages of this invention will become apparent from the description which follows, taken in conjunction with the accompanying drawings.

BRIEF DESCRIPTION OF THE DRAWINGS

The invention will be more readily understood by reference to the accompanying drawings wherein like reference numerals indicate like elements throughout the drawing Figures and in which:

FIG. 4 is a perspective sectional view illustrating the various layers of another article or substrate coated by a method of the present invention.

FIG. 5 is an enlarged perspective view of the circled section illustrated in FIG. 4.

BEST MODE FOR CARRYING OUT THE INVENTION

Figure 1:
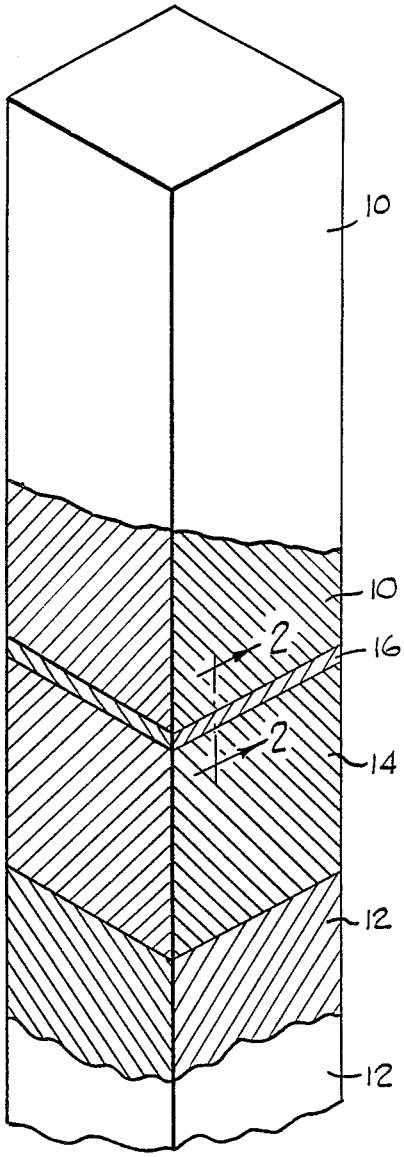
FIG. 1 is a perspective sectional view illustrating the various layers of an article coated by the method of the present invention which coating includes the layered structure of the present invention.
Figure 2:
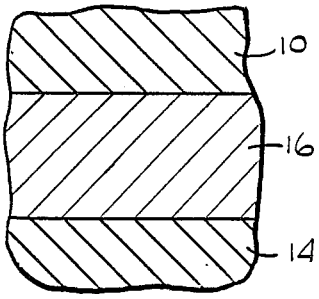
FIG. 2 is a cross-sectional view taken along the lines 2—2 of FIG. 1.

FIGS. 1 and 2 illustrate a layered structure (not numbered) of the present invention for securing or adhering a gold or gold alloy layer 10 to a stainless steel substrate 12. The layered structure includes a hard coating or first layer 14, preferably of a metal nitride such as titanium nitride. If the substrate is stainless steel, the first layer is formed or deposited directly onto the surface of the substrate. If the substrate is brass or some other material, it may be necessary to apply a thin glue layer before applying layer 14.

The layered structure of the present invention also includes a thin transparent layer 16 of pure refractory metal such as Ti, Zr or Hf which is formed or deposited on layer 14. Both first layer 14 and transparent layer 16 are preferably formed or deposited by a cathodic arc plasma deposition i.e. CAPD process. In addition, the pure metal of transparent layer 16 is preferably the same metal as that of the first layer. Accordingly, if the first layer consists of titanium nitride, then the transparent layer would preferably consist of pure titanium.

After depositing transparent layer 16 on first layer 14, gold layer 10 is formed or deposited directly on transparent layer 16, preferably by a magnetron sputtering process.

Transparent layer 16 has been found to significantly reduce the aforementioned delaminating or latent adhesion problem, i.e., peeling of the top gold layer off the base coat, i.e., first layer 14. It is believed that the transparent layer reduces such by acting as a barrier to prevent the alloying ingredients in gold, particularly copper, zinc and indium, from diffusing or migrating to the surface of the first layer, i.e., hard coating. As such, the aforementioned build up of gold alloy ingredients at the interface of the base coat and the top layer is prevented. Accordingly, a much more secure and long lasting bond is provided between the gold layer and the substrate.

Transparent layer 16 in accordance with the present invention also preferably has a thickness of between about 25 and 100 angstroms, optimally about 50 angstroms. Layers thinner than 25 angstroms are believed to be undesirable in that they are apparently not thick enough to prevent gold's alloying ingredients from diffusing to the surface of the hard coating, i.e., first layer 14. Layers thicker than about 100 angstroms are undesirable in that they are not sufficiently transparent. Layer 16 must be transparent so that it will not visually effect the appearance of the hard coating, i.e., first layer 14, which is also gold colored and will, of course, become exposed when the top gold layer wears away.

Figure 3:
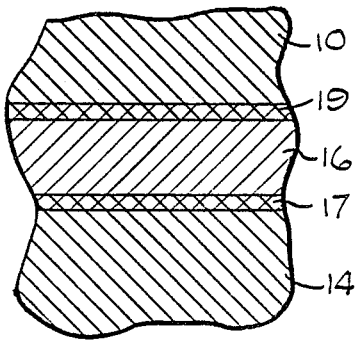
FIG. 3 is a cross-sectional view which is similar to that of FIG. 2 additionally illustrating, however, the provision of graded interfaces or transition zones between the layers illustrated in FIG. 2.

FIG. 3 illustrates another embodiment of the present invention which is identical to that of FIGS. 1 and 2 except that FIG. 3 additionally illustrates the provision of two graded or gradual interfaces, i.e., a graded interface or transition zone 17 located between hard coating layer 14 and transparent layer 16 and another graded interface or transition zone 19 located between transparent layer 16 and top gold layer 20. The provision of transition layers 17 and 19 is in contrast to the interfaces between the same layers illustrated in FIGS. 1 and 2 which have a sharp interface.

Graded interface 17 can be produced by the CAPD means described in the dual coating apparatus described in Randhawa U.S. patent application Ser. No. 236,648. This simply involves controlling the supply of process gas (which is usually nitrogen) as the hard coating layer, i.e., layer 14 is deposited on the substrate. This results in gradual consumption of the process gas which thereby produces the graded transition zone. When enough reactive process gas is consumed, the CAPD means will deposit the layer of pure metal, i.e., transparent layer 16.

Transition layer 19 can also be deposited by the dual coating apparatus described in the Randhawa application. This is done by simply activating the magnetron sputtering means (which deposits the top gold layer) slightly before turning the CAPD means off. Accordingly, an overlap of the two processes occurs, thereby producing the graded or gradual interface between the layers. The use of a graded interface instead of a sharp interface between the respective layers is expected to further enhance the adhesive strength of the layered structure of the present invention.

FIGS. 4 and 5 illustrate another layered structure (not numbered) of the present invention for securing or adhering a gold or gold alloy layer 20 to a substrate 22. Substrate 22 in this embodiment includes a zinc die cast base 24 having electroplated layers of copper, bright nickel and chrome in that order which are identified respectfully as layers 26, 28 and 30. The layered structure for adhering gold layer 20 to substrate 22 includes an adhesive or glue layer 32 of zirconium rich nitride which is deposited on chrome layer 30, a layer 34 of the zirconium carbonitride which is deposited on layer 32 and a thin transparent layer 36 of pure zirconium which is deposited on layer 34. As with the embodiment of FIGS. 1 and 2, layers 32, 34 and 36 of the layered adhesive structure are preferably deposited by a CAPD process. Gold layer 20 is preferably deposited by a magnetron sputtering process.

Table I sets forth the latent adhesion test results of ten gold coated samples having an adhesive layered structure similar to that of FIGS. 4 and 5 with twenty gold coated samples which are also similar to that of FIGS. 4 and 5 except as follows. None of the twenty had a transparent layer of pure refractory metal of the present invention such as Zr. In addition, ten of the twenty had a graded or gradual interface between the gold layer and hard coating as opposed to a sharp interface.

The substrates of all tested samples, i.e., including those having the transparent layer of the present invention were also similar to substrate 22 of FIGS. 4 and 5. All had zinc die cast bases and electroplated layers of copper, bright nickel and chrome. In addition, prior to being coated, all substrates were cleaned by a conventional cleaning process including vapor degreasing, ultrasonic alkaline etching, water rinsing and freon drying.

After cleaning the substrates, all substrates were coated in an apparatus similar to the previously mentioned dual coating apparatus described in Randhawa U.S. patent application Ser. No. 236,648. As also set forth in more detail in the Randhawa application, the coating process generally included evacuating the chamber of the apparatus and then back filling it with nitrogen/argon gas mixture to a pressure of about one to ten milliTorr. The CAPD means in the chamber was then activated as described in the Randhawa application to first clean the substrate and then apply a thin adhesive layer of zirconium rich nitride such as layer 32 illustrated in FIGS. 4 and 5. During this time, substrates were also heated by ion bombardment from these arc sources. Then, acetylene gas was introduced into the chamber to provide a gaseous mixture of acetylene and nitrogen/argon having an acetylene to nitrogen ratio of 0.19. The gases react with the zirconium as also described in the Randhawa application to deposit a layer of zirconium carbonitride such as layer 34 illustrated in FIGS. 4 and 5.

The layer of pure zirconium in the ten samples of the present invention was then deposited on the zirconium carbonitride layer by first withdrawing the reactive process gas mixture of nitrogen and acetylene from the chamber without breaking vacuum and then continuing deposition in the presence of argon gas only. The top gold layer was then deposited on the transparent pure zirconium layer by activating the magnetron sputtering means.

The twenty samples not having the transparent layer of pure zirconium were also prepared without breaking vacuum at any time during the deposition process. In the ten samples having a sharp interface between the zirconium carbonitride layer and the top gold layer, the CAPD means for depositing the zirconium carbonitride layer was shut off before activating the magnetron sputtering means which applied the top gold layer. In the ten samples having the graded or gradual interface between the zirconium carbonitride layer and the top gold layer, the magnetron sputtering means depositing the top gold layer was activated slightly before turning the CAPD means off. As with transition zones 17 and 19 of FIG. 3, this overlapping of the two processes produced the graded or gradual interface between the layers.

The top gold layer in all samples consisted of 65% Au, 12.5% Ag, 12.5% Cu and 5% Zn. All samples were also annealed at 125 degrees Celsius for purposes of accelerating the tests. Adhesion was tested by the scotch tape pull test and, as set forth below, was measured at different time intervals.

TABLE I

| COATING CONTENTS | LATENT RESULTS; ADHESION TEST IN AIR ANNEALING 125° C. |
|---|---|
| ZrCN + GOLD ALLOY (SHARP INTERFACE) | 6 HRS. 10 OUT OF 10 SAMPLES FAILED |
| ZrCN + GOLD ALLOY (GRADED INTERFACE) | 24 HRS. 3 OUT OF 10 SAMPLES FAILED; 48 HRS. 10 OUT OF 10 SAMPLES FAILED |
| ZrCN + Zr (30 to 75 ANGSTROMS) + GOLD ALLOY (SHARP INTERFACE) | 4 DAYS, NONE FAILED; ONE WEEK, 1 OUT OF 10 SAMPLES FAILED; TWO WEEKS, 1 OUT OF 10 SAMPLES FAILED |

From the results set forth in the table, it is clear that the layered structure of the present invention utilizing a thin transparent layer of pure refractory metal such as zirconium is far superior to that not utilizing such. All gold coated parts having the sharp gold/zirconium carbonitride interface failed in six hours. Even the gold coated parts having the graded interface with zirconium carbonitride all failed in forty eight hours. In contrast, over four days passed before one of the gold coated parts having the transparent layer of the present invention failed. Moreover, only one sample of the present invention failed in two weeks. In view thereof, those skilled in the relevant art will readily appreciate that the use of a thin layer of pure refractory metal between the hard coating layer and the top gold layer is extremely effective in preventing the gold layer from peeling off the hard coating layer.

This invention has been described in detail with reference to particular embodiments thereof, but it will be understood that various other modifications can be effected within the spirit and scope of this invention.

What is claimed:

1. A layered structure for adhering gold or an alloy thereof to a substrate, said layered structure comprising:

a first layer overlying a substrate, said first layer including a member selected from the group consisting of metal nitrites, metal carbides and metal carbonitrides wherein said metal is selected from the group consisting of titanium, zirconium and hafnium; and a transparent layer of refractory metal overlying said first layer and underlying gold or an alloy thereof, said transparent layer having a thickness greater than about 25 angstroms and less than about 100 angstroms.

2. A layered structure as claimed in claim 1 wherein said transparent layer has a thickness between about 30 and 75 angstroms.

3. A layered structure as claimed in claim 1 wherein said refractory metal of said transparent layer and said metal of said first layer are the same.

4. A layered structure as claimed in claim 1 wherein said first layer has a thickness greater than about 0.1 microns and less than about 5 microns.

5. A layered structure as claimed in claim 1 wherein said refractory metal is selected from the group consisting of titanium, zirconium and hafnium.

6. A layered structure as claimed in claim 1 wherein said first layer and said transparent layer are formed by a cathodic arc plasma deposition process.

7. A layered structure as claimed in claim 1 further comprising a graded interface between said first layer and said transparent layer.

8. A layered structure as claimed in claim 1 further comprising a graded interface between said transparent layer and said gold or alloy thereof.

9. A layered structure as claimed in claim 1 further comprising an adhesive layer between said first layer and said substrate.

10. An article of jewelry and the like comprising:

a substrate; and a multi-layered coating on said substrate, said multi-layered coating including:

a first layer overlying said substrate, said first layer including a member selected from the group consisting of metal nitrides, metal carbides and metal carbonitrides wherein said metal is selected from the group consisting of titanium, zirconium and hafnium;

a transparent layer of refractory metal overlying said first layer, said transparent layer having a thickness between about 25 and 100 angstroms; and a top layer of gold or an alloy thereof overlying said transparent layer of refractory metal.

* * * * *

UNITED STATES PATENT AND TRADEMARK OFFICE

CERTIFICATE OF CORRECTION

PATENT NO. : 4,898,768

DATED : February 6, 1990

INVENTOR(S) : Harbhajan S. Randhawa

It is certified that error appears in the above-identified patent and that said Letters Patent is hereby corrected as shown below:

ON TITLE PAGE: Item [73] delete "Vac Fec" and insert --Vac Tec--.

Col. 6, line 33, claim 1, delete "nitrites" and insert --nitrides--.

Signed and Sealed this

Thirty-first Day of December, 1991

*Attest:*

*Attesting Officer*

HARRY F. MANBECK, JR.

*Commissioner of Patents and Trademarks*